US007014280B2

(12) United States Patent
Borgen et al.

(10) Patent No.: US 7,014,280 B2
(45) Date of Patent: Mar. 21, 2006

(54) DISPLAY DEVICE HAVING DUAL PURPOSE SHELVING

(75) Inventors: Arden L. Borgen, Des Moines, IA (US); David R. Hunt, Urbandale, IA (US)

(73) Assignee: Margaret Platt Borgen, Des Moines, IA (US)

( * ) Notice: Subject to any disclaimer, the term of this patent is extended or adjusted under 35 U.S.C. 154(b) by 328 days.

(21) Appl. No.: 10/361,654

(22) Filed: Feb. 10, 2003

(65) Prior Publication Data

US 2004/0154498 A1 Aug. 12, 2004

(51) Int. Cl.
*A47F 3/04* (2006.01)

(52) U.S. Cl. ..... 312/116; 108/109; 211/150; 211/85.23; 211/88.03

(58) Field of Classification Search ..... 108/102, 108/50.13, 108–109, 179, 147.17; 211/187, 211/150, 85.23, 88.03; 248/242; 312/116; 62/251–252, 255
See application file for complete search history.

(56) References Cited

U.S. PATENT DOCUMENTS

| | | | | |
|---|---|---|---|---|
| 1,596,075 | A | | 8/1926 | Buswell |
| 1,892,687 | A | | 1/1933 | Teufel |
| 3,625,371 | A | | 12/1971 | Dill |
| 4,037,896 | A | | 7/1977 | Kennedy, Jr. et al. |
| 4,174,086 | A | | 11/1979 | Verberkmoes |
| 4,575,105 | A | | 3/1986 | le Pierres |
| 4,608,835 | A | * | 9/1986 | Kooy ..... 62/255 |
| 4,760,708 | A | | 8/1988 | Karashima |
| 4,953,363 | A | * | 9/1990 | Primozic ..... 62/255 |
| 5,022,539 | A | * | 6/1991 | Rushing et al. ..... 108/108 |
| 5,022,720 | A | * | 6/1991 | Fevig et al. ..... 312/116 |
| 5,181,622 | A | * | 1/1993 | Hallgrimsson ..... 211/183 |
| 5,526,944 | A | * | 6/1996 | Merl ..... 108/108 |
| 5,531,159 | A | | 7/1996 | Stubblefield |
| 5,599,079 | A | * | 2/1997 | Ranno et al. ..... 312/116 |
| 5,964,512 | A | | 10/1999 | Borgen |
| 6,170,678 | B1 | | 1/2001 | de la Fuente |
| 6,234,328 | B1 | * | 5/2001 | Mason ..... 211/150 |
| 6,584,916 | B1 | * | 7/2003 | Felton et al. ..... 108/107 |
| 2002/0027115 | A1 | * | 3/2002 | Gay et al. ..... 211/187 |
| 2005/0011420 | A1 | * | 1/2005 | Costa et al. ..... 108/108 |

FOREIGN PATENT DOCUMENTS

JP 2000201784 * 7/2000

* cited by examiner

*Primary Examiner*—Janet M. Wilkens
*Assistant Examiner*—Hanh V. Tran
(74) *Attorney, Agent, or Firm*—McKee, Voorhees & Sease, P.L.C.

(57) ABSTRACT

A display device having dual purpose shelving includes spaced apart end brackets and a pivotal shelf. The shelf pivots from an upstanding position to a horizontal position. Below the shelf are a pair of spaced apart rods one of which is fixed and the other of which is moveable. The moveable rod can move to a stored position below the shelf or it can be moved to an unstored position for receiving a plurality of vases between the two spaced apart rods.

15 Claims, 6 Drawing Sheets

DISPLAY DEVICE HAVING DUAL PURPOSE SHELVING

BACKGROUND OF THE INVENTION

The present invention relates to a display device having dual purpose shelving.

Many different types of shelving have been provided within display devices and within cooled displayed devices. There is a need however for a dual purpose shelving to be used in a display device that will permit a typical horizontal shelf to be used, but will permit the shelf to be rendered inoperative so that other types of holding devices may be used to display products.

Therefore a primary object of the present invention is the provision of an improved display device having dual purpose shelving.

A further object of the present invention is the provision of a display device having dual purpose shelving that permits a horizontal shelf to be moved from a horizontal operative position to an upstanding inoperative position.

A further object of the present invention is the provision of an improved dual purpose shelving which includes two spaced apart rods for receiving a plurality of vases to display flowers within the vases.

A further object of the present invention is the provision of an improved display device having dual purpose shelving which is economical to manufacture, durable in use, and efficient in operation.

BRIEF SUMMARY OF THE INVENTION

The foregoing objects maybe achieved by a display device having an upstanding support. First and second end brackets are operatively connected to the upstanding support in spaced relation to one another. A shelf having a support surface and first and second opposite ends is mounted to the first and second end brackets. It is mounted for movement from an operative position wherein the support surface is approximately horizontal to an inoperative position wherein the support surface is upstanding. A first rod is supported between the first end bracket and the second end bracket. A second rod is also supported by the first and second end brackets and is moveable with respect to the first and second end brackets from a stored position below the shelf when the shelf is in its operative position to an unstored position parallel and below the first rod.

According to one feature of the invention each of the first and second brackets have an elongated slot therein and the second rod is moveable in the elongated slots from its stored to its unstored positions.)

According to another feature of the invention the upstanding support includes a panel having an air vent extending there through. The shelf includes a seal mounted thereon that forms a sealing engagement with the panel below the air vent when the shelf is in its inoperative position.

According to another feature of the invention the shelf includes a deflector panel that is in a deflector position below the air vent when the shelf is in its inoperative position. The deflector panel deflects air from the air vent toward the first and second rods when the deflector panel is in the deflector position.

According to another feature of the invention, rather than using elongated slots in the first and second end brackets, a pair of links interconnects the second rod with the first and second end brackets. The links are pivotally mounted so as to permit the second rod to swing from its stored position to its unstored position.

DETAILED DESCRIPTION OF THE INVENTION

Figure 1:
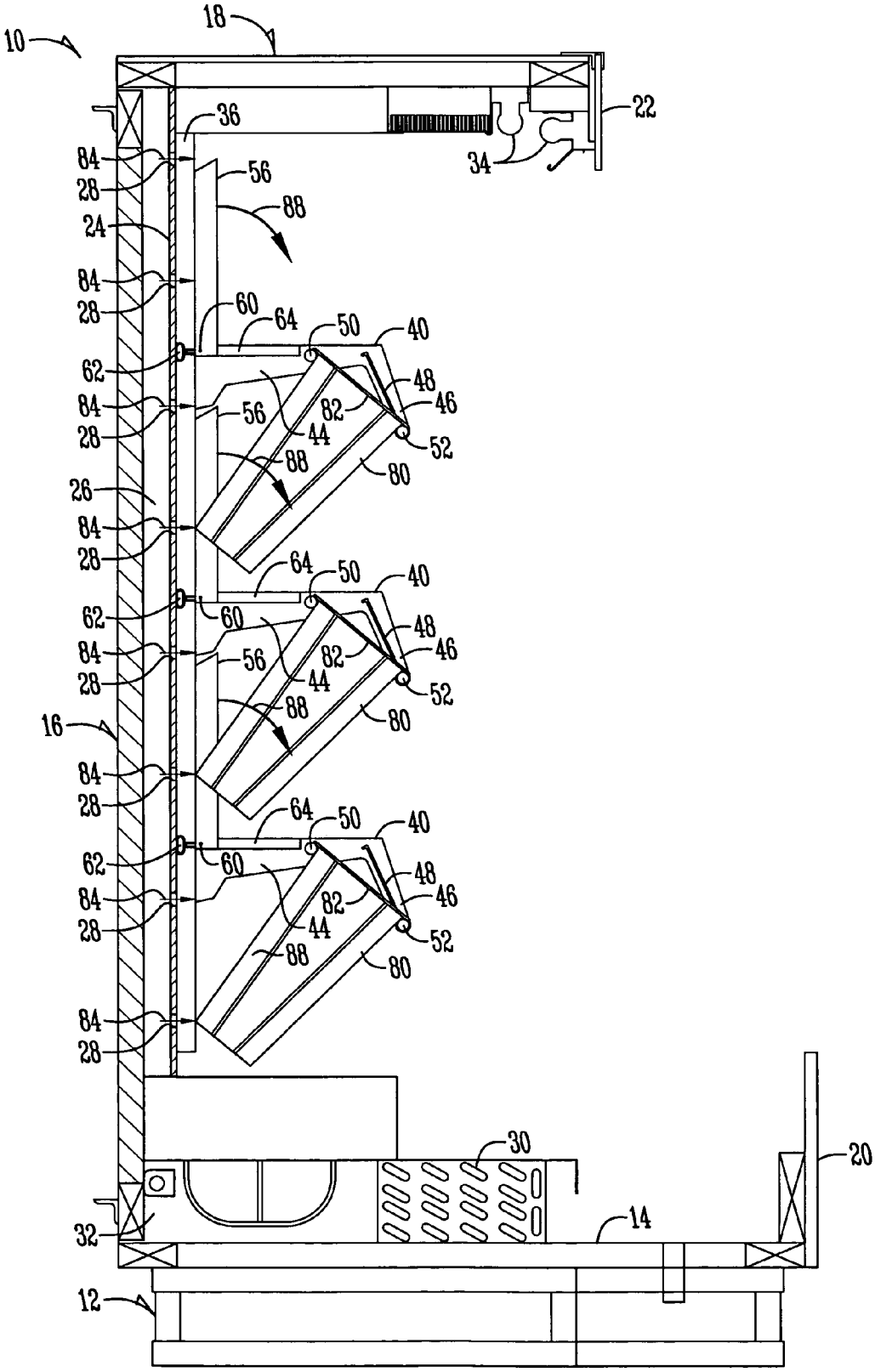
FIG. 1 is a side sectional view of a display case made according to the present invention.
Figure 2:
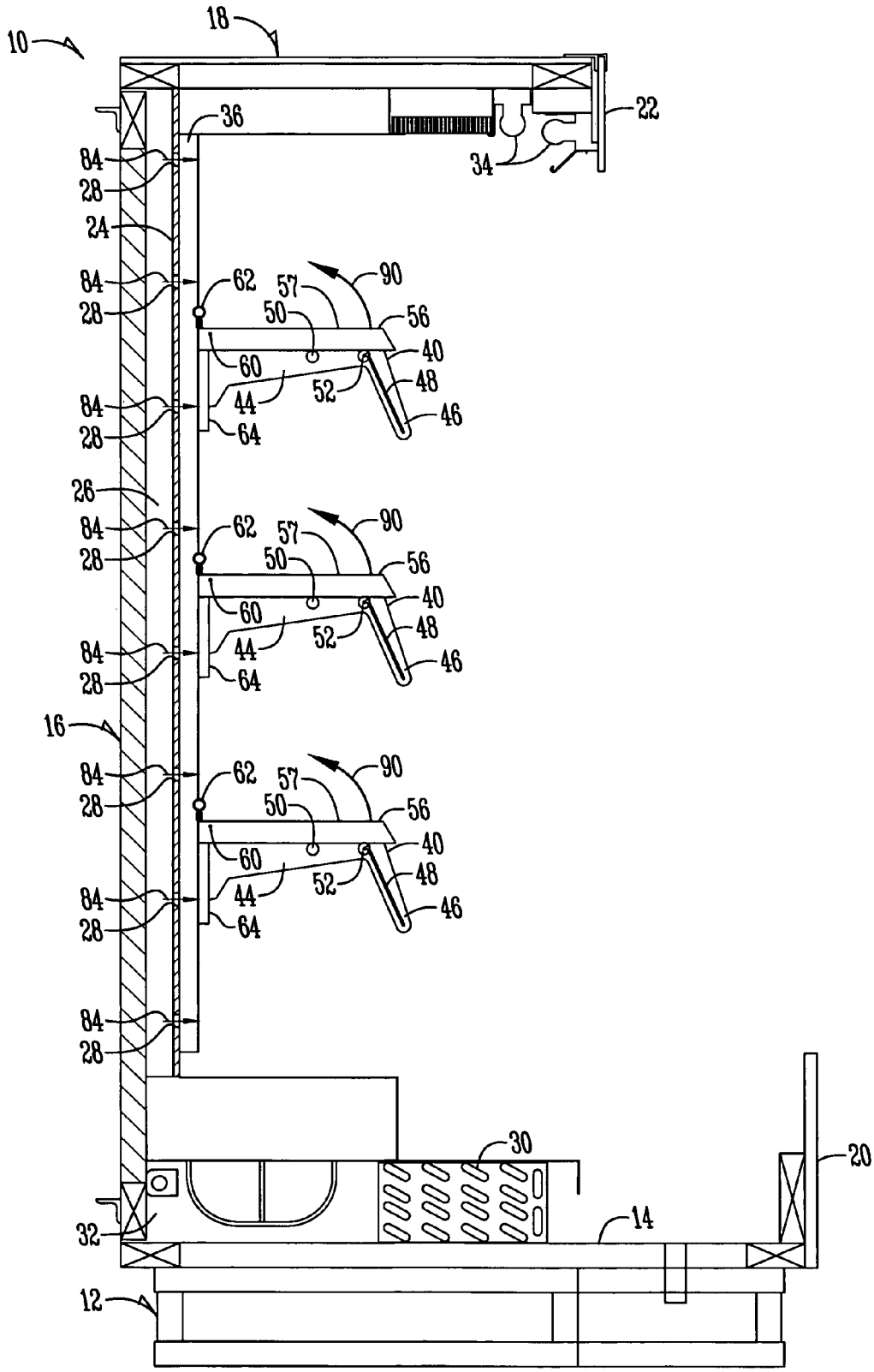
FIG. 2 is a view similar to FIG. 1, but showing the shelves in a different position.
Figure 3:
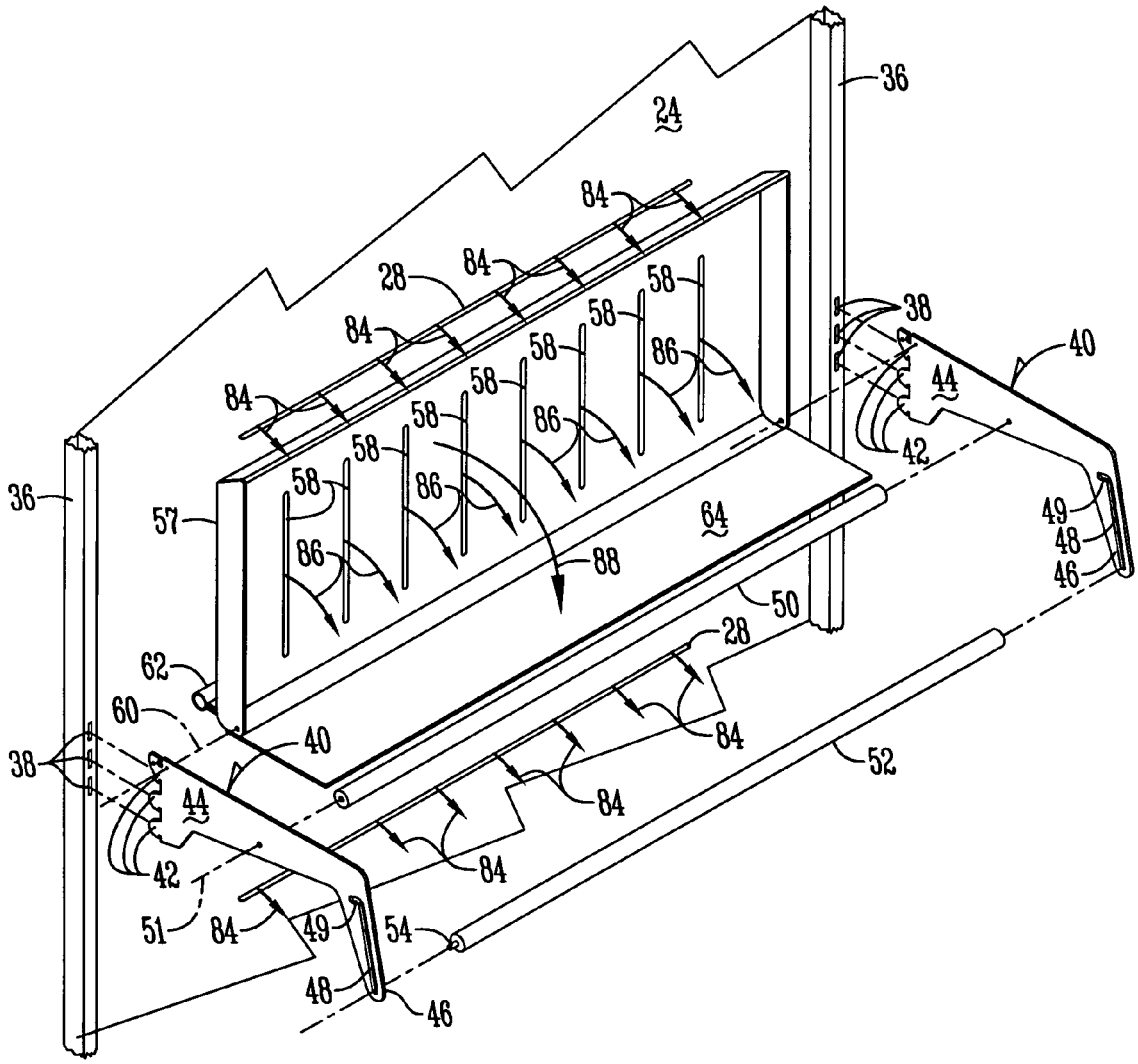
FIG. 3 is an exploded perspective view of one of the dual purpose shelves of the present invention.

Referring to FIGS. 1–3 the numeral 10 generally designates a display case made according to the present invention. Display case 10 includes a base frame 12 that rests upon a supporting surface. The display case 10 includes a bottom wall 14, a back wall 16, a top wall 18, a lower front ledge wall 20 and an upper front ledge wall 22. Extending parallel to the back wall 16 is a back panel 24 which forms a vertical cool air channel 26 by virtue of its spaced relation to the back wall 16. Back panel 24 includes a plurality of cool air outlets 28. Outlets 28 are shown to be elongated slots in the drawings, but they could also be perforations or holes in the panel 24. Cooling coils 30 are provided in the bottom of the display case 10 and a fan (not shown) directs air across the cooling coils 30 into an air plenum 32 and then upwardly into the cool air channel 26. Air then passes outwardly through the cool air outlets 28 in back panel 24 as indicated by the arrows 84. Lights 34 are shown schematically at the upper end of the display case 10.

Extending vertically and attached to the back panel 24 are two parallel vertical bracket mounts 36 which are shown best in FIG. 3. These bracket mounts 36 include a plurality of bracket receiving holes 38 therein.

A spaced apart pair of end brackets 40 each include bayonet members 42, a horizontal portion 44 and a downwardly extending portion 46. The bayonet members 42 fit within the bracket receiving holes 38 to secure the end brackets 40 in place. Each end bracket 40 includes an elongated slot 48 therein. The upper end of slot 48 includes a J-shaped hook portion 49.

Extending between end brackets 40 is a fixed rod 50 which is mounted to the end brackets 40 for rotation about a rod axis 51. A moveable rod 52 has end pins 54 at its opposite ends which are slideably mounted within the slots 48 of end brackets 40. The specific means for attaching the rods 52 in the slots 48 for sliding movement therein are not shown, but could include nuts or bolts at the ends of the pins 54. A moveable rod 52 is capable of sliding movement within the slots 48 from its unstored position shown in FIG. 1 to its stored position in FIG. 2. In its stored position the pins 54 fit within the hook portion 49 of slot 48.

A shelf 56 includes a support surface 57 and is pivotally mounted about a hinge axis 60 for movement from the inoperative upstanding position shown in FIG. 1 to the operative position shown in FIG. 2 wherein support surface 57 is approximately horizontally disposed. In its inoperative position such as shown in FIGS. 1 and 3, the shelf 56 includes a plurality of air slots 58 which permit air to pass from the cool air outlets 28 through the air slots 58 into the area between the two rods 50, 52. Arrows 84, 86 show the movement of air through these slots.

Shelf 56 is provided with a sealing member 62 which engages the back panel 24 when the shelf 56 is in its inoperative position shown in FIGS. 1 and 3. The engagement of this sealing member prevents cool air that is passing through the slots 28 above the sealing member 62 from passing downwardly and permits the cooled air to move outwardly toward the rods 50, 52. To further facilitate this air movement, a deflector member 64 is attached to the shelf member 56. When the shelf member 56 is in its upstanding inoperative position such as shown in FIGS. 1 and 3, the deflector 64 extends horizontally outwardly toward the fixed rod 50. Thus the air above the sealing member 62 passes through cool air channels 26 as shown by arrows 84 and further passes through air slots 58 in the shelf 56 as shown by the arrows 86. It is further deflected horizontally toward the fixed rod 50 by means of the deflector 64.

When it is desired to use vases for displaying objects such as flowers, the shelf 56 is moved from its operative position shown in FIG. 2 to its inoperative upstanding position shown in FIG. 3. Moveable rod 52 is moved from the hook portion 49 of slot 48 to the extreme lower end of slot 48. Then vases 80 are inserted between the two rods 50, 52. Each vase includes an upper flange 82 which prevents the vase from passing completely through the two slots 50, 52, and which supports the vases at an angular disposition so that their contents such as flowers are readily visible. The cool air passing through slot 28 and slots 58 as shown by arrows 84, 86 is deflected by deflector 64 towards the upper ends of the vases 80 thereby providing cool air to the contents of the vases 80.

If it is desired to use the shelf 56, the vases 80 are removed upwardly and the moveable rod 52 is moved up to the J-shaped portion 59 of the slot 48 to be in its stored position. The shelf 56 is then pivoted downwardly in the direction shown by arrow 88 in FIG. 1 so that it rests upon one or both of the rods 50, 52 as shown in FIG. 2. Conversely if the horizontal shelves are not needed and the vases are preferred, the shelf 56 is pivoted upwardly in the direction of arrow 90 (FIG. 2) to the upstanding position shown in FIG. 1. The moveable rod 52 is moved from its stored position in FIG. 2 to its unstored position in FIG. 1. The vases are inserted and the shelf thus provides a dual purpose.

Figure 4:
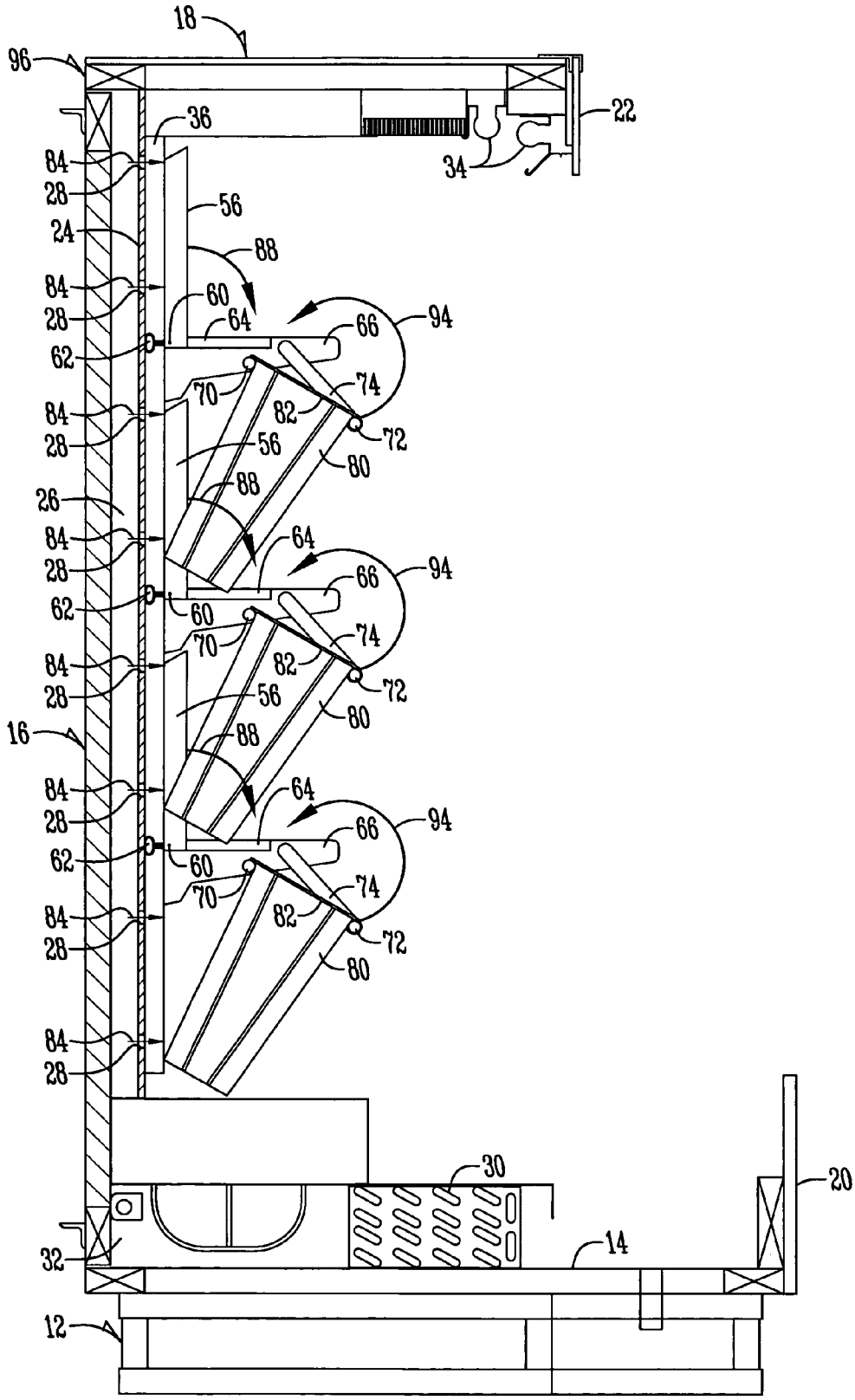
FIG. 4 is a sectional view similar to FIG. 1, but showing a second embodiment of the invention.
Figure 5:
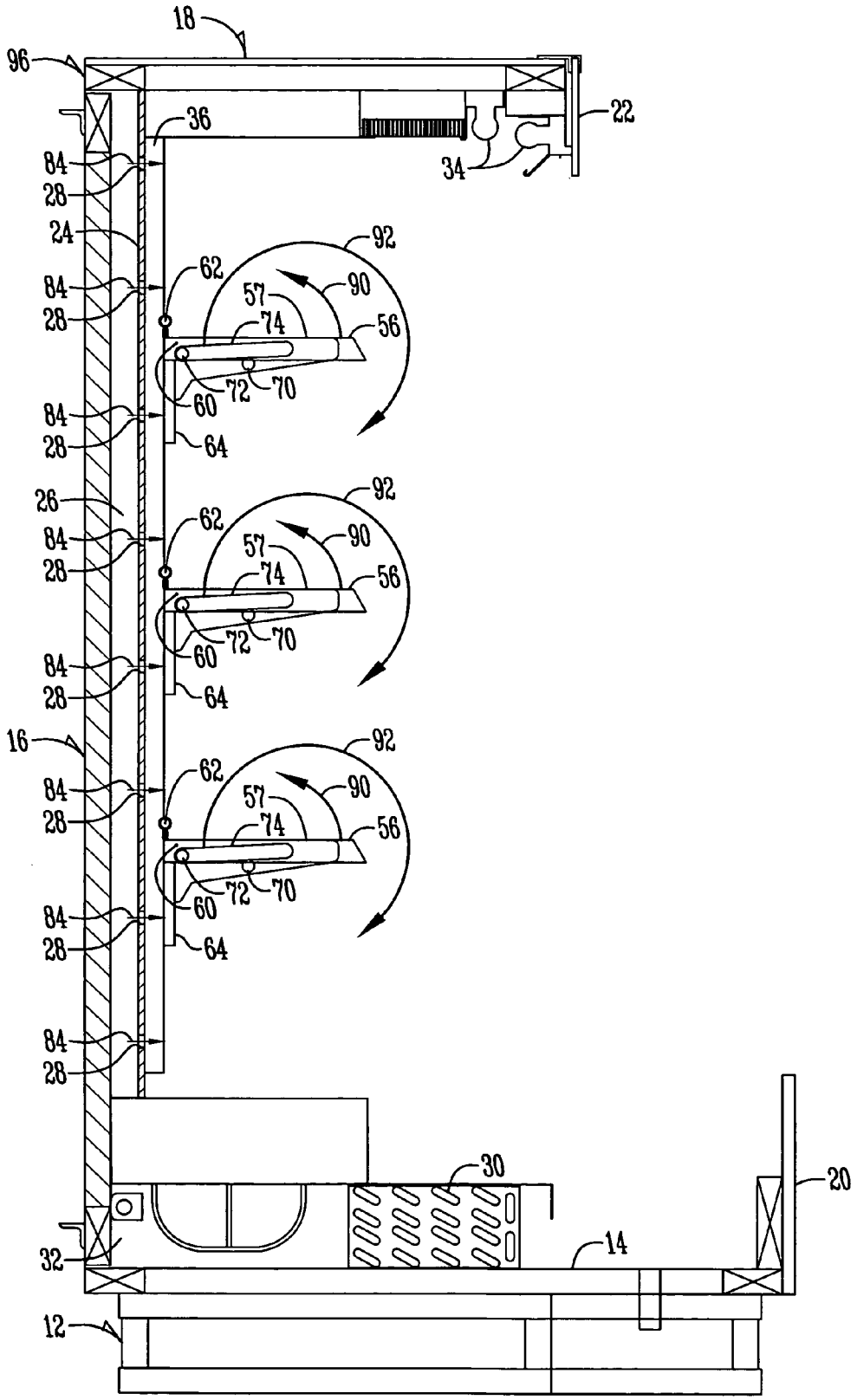
FIG. 5 is a view similar to FIG. 4, showing the shelving in a different position.
Figure 6:
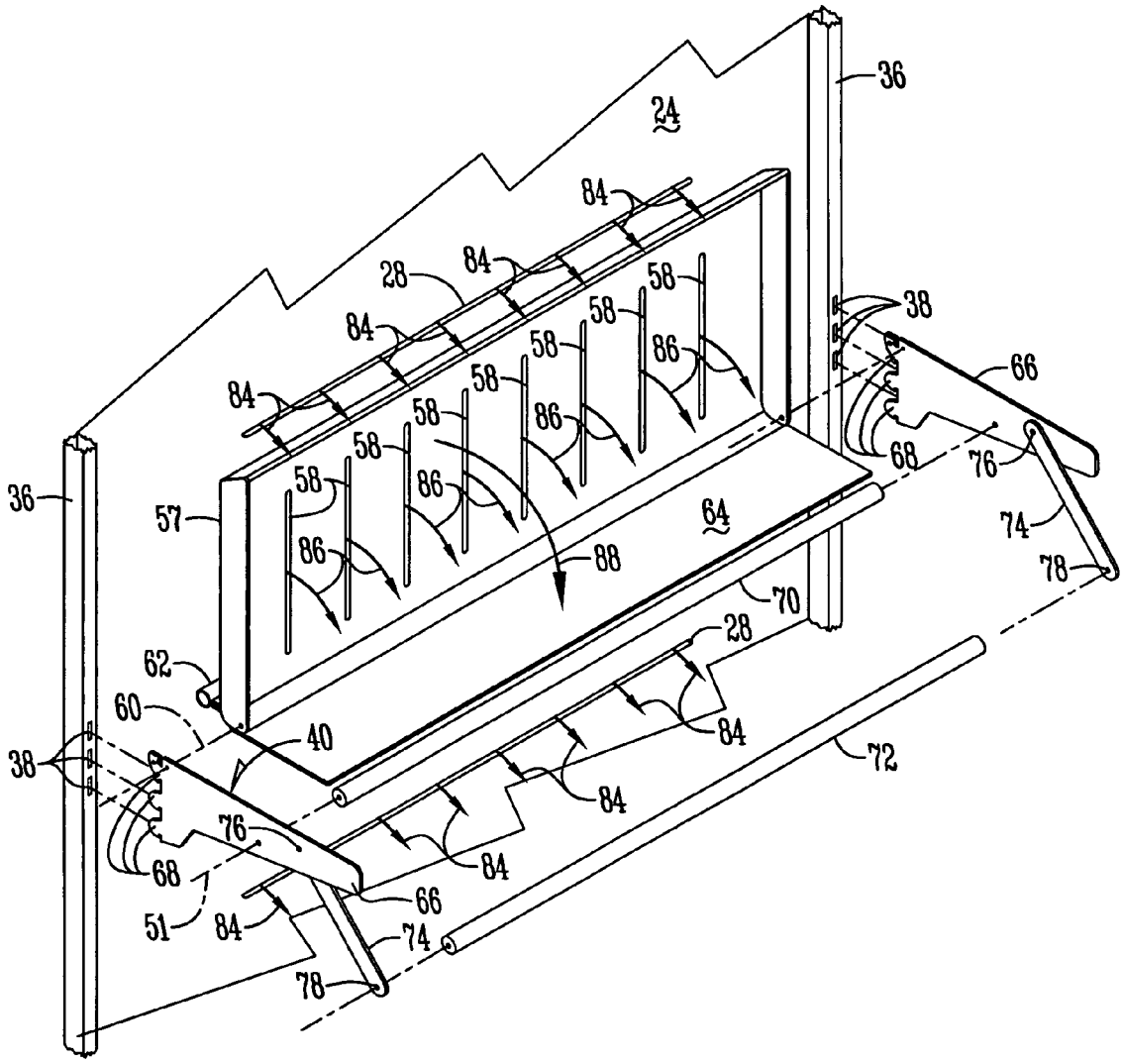
FIG. 6 is an exploded perspective view showing one of the shelves of the present invention.

FIGS. 4–6 show a modified form of the invention. The display case is designated by the numeral 96, but has many of the same components as the display case 10. Accordingly corresponding numbers are used to identify the same parts. Similarly the shelves 56 are identical and have numerals corresponding to those shown in FIGS. 1–3.

The end brackets shown in FIGS. 4–6 are designated by the numeral 66 and do not include the slot 48 or the downwardly projecting portion 46 as shown by the end brackets 40 in FIGS. 1–3. The end brackets 66 include a plurality of bayonet members 68 which fit within the slots 38 of upstanding bracket mounts 36. A fixed rod 70 is rotatably mounted at its opposite ends to the two end brackets 66. A moveable rod 72 is pivoted at its opposite ends to a pair of swing links 74 which in turn are pivoted to the end brackets 66 for pivotal movement about a bracket pivot 76. The rod 72 is pivoted to the end brackets for pivotal movement about the rod pivot 78.

When the shelf 56 is in its upstanding inoperative position such as shown in FIG. 4, the vases 80 may be inserted between the two spaced apart rods 70, 72. However, when it is desired to use the horizontal shelves 56, the moveable rod 72 is pivoted upwardly in the direction shown by arrow 94 in FIG. 4 to its stored position which is shown in FIG. 5. The shelves 56 are pivoted downwardly as indicated by arrow 88 in FIG. 4. When it is desired to use the vases, the shelf 56 is pivoted upwardly in the direction indicated by arrows 90 in FIG. 5 to its upstanding position, and the links 74 are pivoted in the direction indicated by arrow 92 in FIG. 5 so as to move rod 72 to the position shown in FIG. 4. Then the vases 80 may be inserted and the device used in that manner.

Thus the device provides a highly flexible dual purpose shelving system for cool displaying case. Shelves can be used to support object on their horizontal support surfaces 57 or they can be moved to their upstanding position and the vases 80 inserted between the two rods 50, 52 or 70, 72. When the shelves are moved to their upstanding inoperative position, the moveable rod 52 of FIG. 1 can be moved upwardly to the J-shaped portion 49 of the slot 48 to be stored. The moveable rod 52 can be moved downwardly to the bottoms of the slots 46 for receiving the vases 80.

Similarly, the rod 72 shown in FIGS. 4–6 can be stored in its stored position shown in FIG. 5 or can be pivoted to its unstored position shown in FIG. 4 for receiving the vases 80. The slots 58 in the shelf 56 and the deflector panel 64 attached to the shelf 56 ensure that the air exiting from cooling slots 28 is directed toward the vases 80 when the shelf 56 is in its upstanding position.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A display device comprising:

an upstanding support;

first and second end brackets operatively connected to the upstanding support in spaced relation to one another;

a shelf having a support surface and first and second opposite ends mounted to the first and second end brackets, respectively, for movement from an operative position wherein the support surface is horizontal to an inoperative position wherein the support surface is upstanding;

a first rod having a first rod end supported by the first end bracket and a second rod end supported by the second end bracket;

a second rod having a first rod end supported by the first end bracket and a second rod end supported by the second end bracket;

the second rod being movable with respect to the first and second end brackets from a stored position below the shelf when the shelf is in the operative position to an unstored position parallel to, and below, the first rod.

2. A display device according to claim 1 wherein the first and second brackets each have an elongated slot therein, the second rod being movable in the elongated slots of the first and second brackets from the stored to the unstored positions.

3. A display device according to claim 1 wherein the upstanding support comprises a panel having an air vent extending there through, the shelf having a seal mounted thereon that forms a sealing engagement with the panel below the air vent when the shelf is in the inoperative position.

4. A display device according to claim 3 wherein the shelf includes a deflector panel that is in a deflector position below the air vent when the shelf is in the inoperative position, the deflector panel deflecting air from the air vent toward the first and second rods when in the deflector position.

5. A display device according to claim 1 wherein the second rod includes first and second links connected to its first and second opposite rod ends, the first link being pivotally mounted to the first support bracket and the second link being pivotally mounted to the second support bracket, whereby the first and second links permit the second rod to pivot and swing from the stored position to the unstored position.

6. A display device according to claim 1 wherein the shelf rests upon at least one of the first and second rods when the shelf is in the operative position and the second rod is in the stored position.

7. A display device comprising:

an upstanding support;

first and second end brackets operatively connected to the upstanding support in spaced relation to one another;

first and second rods each having opposite ends supported by the first and second end brackets, the first and second rods being parallel to one another and being spaced a predetermined distance apart from one another;

at least one vase having a lower portion between the first and second rods, and an upper portion larger than the predetermined distance between the first and second rods so as to prevent the vase from falling between the first and second rods;

the at least one vase being manually upwardly removable from between the first and second rods;

an elongated shelf having a shelf surface and having opposite ends supported by the first and second end brackets, the shelf being movable from an inoperative position wherein the shelf surface is upstanding to an operative position wherein the shelf surface is disposed for supporting objects;

the shelf being in the inoperative position when the at least one vase is positioned between the first and second rods.

8. A display device according to claim 7 wherein the second rod is mounted between the first and second brackets for movement from an unstored position wherein the second rod is said predetermined distance from said first rod and is below the first rod, to a stored position that is higher than the unstored position relative to the first rod.

9. A display device according to claim 8 wherein the first and second brackets each include an elongated slot, the opposite ends of the second rod being in the slots of the first and second brackets respectively, the second rod being movable within the slots of the first and second brackets from the stored to the unstored positions.

10. A display device according to claim 8 and further comprising a first link pivotally mounted to one of the opposite ends of the second rod and a second link pivotally mounted to the other of the opposite ends of the second rod, the first and second links being pivotally connected to the first and second brackets, respectively.

11. A display device comprising:

a cooling display case having a back wall, a top wall, and a bottom wall partially enclosing a display compartment;

first and second brackets mounted within the display case in spaced relation to one another;

a shelf having opposite ends and a support surface, the first bracket supporting one of the opposite ends of the shelf, and the second bracket supporting the other of the opposite ends of the shelf;

the shelf being movable from an operative position wherein the support surface of the shelf is disposed to support objects to an inoperative position wherein the support surface of the shelf is upstanding;

a first rod and a second rod each having opposite ends supported by the first and second brackets respectively, the first and second rods being parallel to one another and spaced a predetermined distance apart from one another;

the first and second rods being positioned below the shelf when the shelf is in the operative position;

at least one vase having a lower portion between the first and second rods, and an upper portion larger than the predetermined distance between the first and second rods so as to prevent the vase from falling between the first and second rods;

the at least one vase being manually upwardly removable from between the first and second rods;

the shelf being in the inoperative position when the at least one vase is positioned between the first and second rods.

12. A display device according to claim 11 wherein the second rod is movable with respect to the first rod from an unstored position supporting the one vase to a stored position wherein the vase is manually removed from between the first and second rods and the second rod is higher than when in the unstored position.

13. A display device according to claim 12 wherein the first and second brackets each include an elongated slots therein, one of the opposite ends of the second rod being in the slot of the first bracket and the other of the opposite ends of the second rod being in the slot of the second bracket, the second rod being movable in the slots of the first and second brackets when moving from the unstored to the stored positions.

14. A display device according to claim 11 and further comprising at least one cool air vent in the back wall of the cooling display case for delivering cool air into the display compartment above the first rod, the shelf having a sealing member that moves into sealing engagement with the back wall of the cooling display case below the cool air vent when the shelf is in the inoperative position.

15. A display device according to claim 11 wherein the shelf includes a deflector panel for deflecting the cool air from the cool air vent to the vase when the shelf is in the inoperative position.

* * * * *